United States Patent [19]

Tyus

[11] 4,036,146

[45] July 19, 1977

[54] PASSENGER TRANSPORTATION SYSTEM

[76] Inventor: Philranzo Tyus, 225 S. Witmer No. 104, Los Angeles, Calif. 90026

[21] Appl. No.: 633,247

[22] Filed: Nov. 19, 1975

[51] Int. Cl.[2] ..... B61B 13/00

[52] U.S. Cl. ..... 104/1 R; 104/119; 104/121; 104/139; 104/146; 104/245; 105/144; 105/146

[58] Field of Search ..... 104/139, 138 R, 138 G, 104/140, 146, 242, 245, 71, 73, 119, 121, 243, 246, 118, 1 R; 105/365, 141, 144, 146

[56] References Cited

U.S. PATENT DOCUMENTS

| | | | |
|---|---|---|---|
| 883,441 | 3/1908 | Andrews | 104/139 |
| 1,900,914 | 3/1933 | Cornet | 104/242 |
| 2,985,479 | 5/1961 | Ortega et al. | 104/245 |
| 3,114,333 | 12/1963 | Fowler et al. | 104/71 |
| 3,405,650 | 10/1968 | Hawes | 104/119 |
| 3,508,497 | 4/1970 | Matsukata | 104/138 R |

FOREIGN PATENT DOCUMENTS

| | | | |
|---|---|---|---|
| 11,737 | 2/1902 | Norway | 104/146 |
| 1,104,746 | 2/1968 | United Kingdom | 104/121 |

*Primary Examiner*—Albert J. Makay
*Assistant Examiner*—Randolph A. Reese
*Attorney, Agent, or Firm*—Christie, Parker & Hale

[57] ABSTRACT

A passenger transportation system includes a transport vehicle which travels in the interior of an elongated tunnel formed from a series of concrete modular conduits. The cross-section of the conduit interior includes a bottom surface on which the vehicle travels, a pair of spaced apart side walls, and a pair of spaced apart upper wall surfaces extending inwardly from the side walls and on opposite sides of an elongated slotted opening extending lengthwise along the top of the conduit tunnel. The transport vehicle is supported by a suspension system which includes a plurality of carrier frames, each having guide rollers traveling along the bottom surface, the side walls, and the upper wall surfaces of the conduit. The guide rollers are supported by respective biasing elements which urge the guide rollers into continuous contact with the walls of the tunnel to keep the vehicle centered in the tunnel during transit. The top of the conduit tunnel is at ground level and only the top section of the vehicle projects though the central top opening of the tunnel above ground level. Doorways are provided in portions of the vehicle top section for allowing passengers at round level to enter the passenger compartment of the vehicle.

6 Claims, 6 Drawing Figures

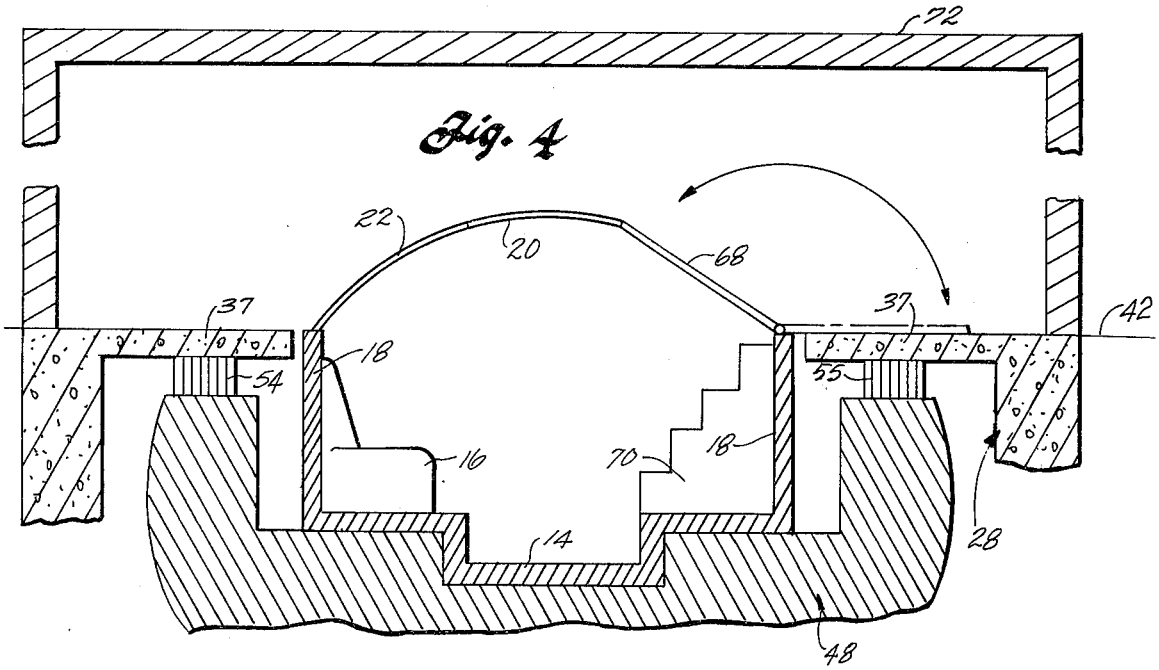
Fig. 4
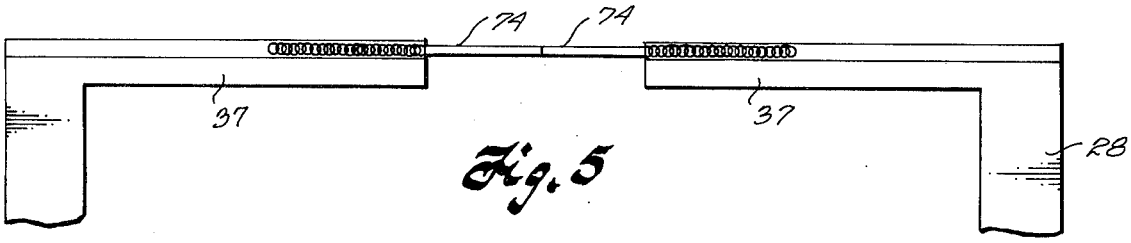
Fig. 5
Fig. 6
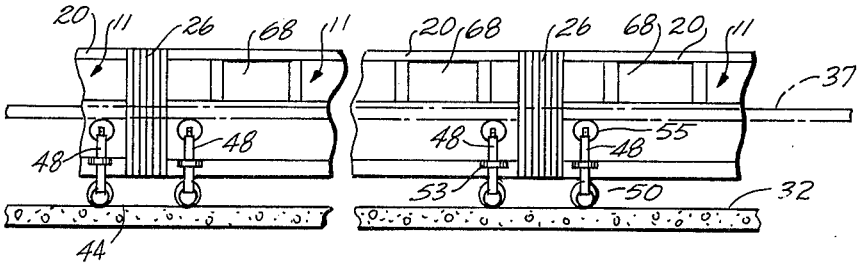

PASSENGER TRANSPORTATION SYSTEM

BACKGROUND

This invention relates to transport systems, and more particularly to an improved system primarily used for the mass transportation of passengers in urban areas.

In the past a variety of transportation systems such as commuter trains, buses, and subways have been used to transport large numbers of passengers in urban areas. An aerodynamically supported train and track system also has been disclosed in U.S. Pat. No. 3,498,234 to Roumejon.

A major disadvantage of subways is the extremely high cost of building underground tunnels and passenger loading areas, not to mention the usual cost of track maintenance and safety systems.

Conventional above-ground systems, such as commuter trains and buses, are hampered in their efforts to efficiently move large numbers of passengers in urban areas having large amounts of snow and rain, or otherwise subject to inclement weather conditions. Moreover, commuter train systems are costly in terms of initial capital expenditures, maintenance, and required complex safety systems. Buses are somewhat less costly, but their effectiveness in quickly and safely moving large numbers of passengers in downtown areas is typically hampered by traffic congestion problems.

SUMMARY

This invention provides an improved transportation system which is especially adaptable for efficiently transporting large numbers of passengers in urban areas. The system can be put into operation for relatively low capital installation and equipment costs. The required safety systems also are relatively inexpensive. In addition, the efficiency of this system is moving large numbers of passengers is not substantially effected by large amounts of snow or rain.

Briefly, the passenger transportation system comprises a transport vehicle and an elongated conduit having a hollow interior in which the vehicle travels. The interior of the conduit has a bottom surface, spaced apart side walls, and an upper wall surface extending inwardly from the side walls and spaced above the conduit bottom surface. Drive means are provided for transporting the vehicle along the conduit interior. A suspension system attached to the transport vehicle includes lower guide means and lateral guide means for traveling along and in engagement with the bottom surface and opposite side walls of the conduit, respectively, together with spaced apart upper guide means for traveling along and in engagement with spaced apart portions of the conduit upper wall suface. The suspension system also includes biasing means for urging the guide means outwardly into contact with the conduit wall surfaces for keeping the vehicle on-center on the conduit cross-section during transit along the conduit.

Preferably, the guide means comprise upper guide rollers, lower guide rollers, and lateral guide rollers all engaged with respective portions of the conduit upper wall surface, bottom surface, and side wall surfaces, respectively. The guide rollers are all preferably attached to a rigid carrier frame, and a plurality of the carrier frames are attached to passenger-carrying portions along the length of the transport vehicle.

In the preferred form of the invention, an elongated opening extends lengthwise through the top surface of the conduit. Preferably, the opening in the conduit is at or near ground level, with the remaining portion of the conduit being below ground level. The transport vehicle includes an interior for carrying passengers below ground level, and only a top section of the vehicle projects through the opening along the length of the conduit. Access to the interior of the vehicle is provided from ground level through entryways in the projection top section of the vehicle.

The transport vehicle guide system and conduit enhance the speed and safety of the vehicle without requiring complex safety systems. The system also can be insulated from ordinary traffic problems of downtown areas which buses, and even commuter trains, must often contend with; and the cost of building and installing the conduit is greatly less expensive than subway systems. The system also has low maintenance costs. In addition, since the conduit can be located below ground level, and passengers can gain access through the opening in the top of the conduit, the system is insulated from inclement weather conditions, such as the buildup of large amounts of snow or heavy rainfall.

These and other aspects of the invention will be more fully understood by referring to the following detailed description and the accompanying drawings.

DRAWINGS

FIG. 4 is a fragmentary schematic cross-sectional view illustrating a means for gaining access to the interior of the transport vehicle;

FIG. 5 is a fragmentary schematic cross-sectional view illustrating a means for closing the open top of the conduit; and FIG. 6 is a fragmentary schematic elevation view, partly in cross-section, taken on line 6—6 of FIG. 1.

DETAILED DESCRIPTION

Figure 1:
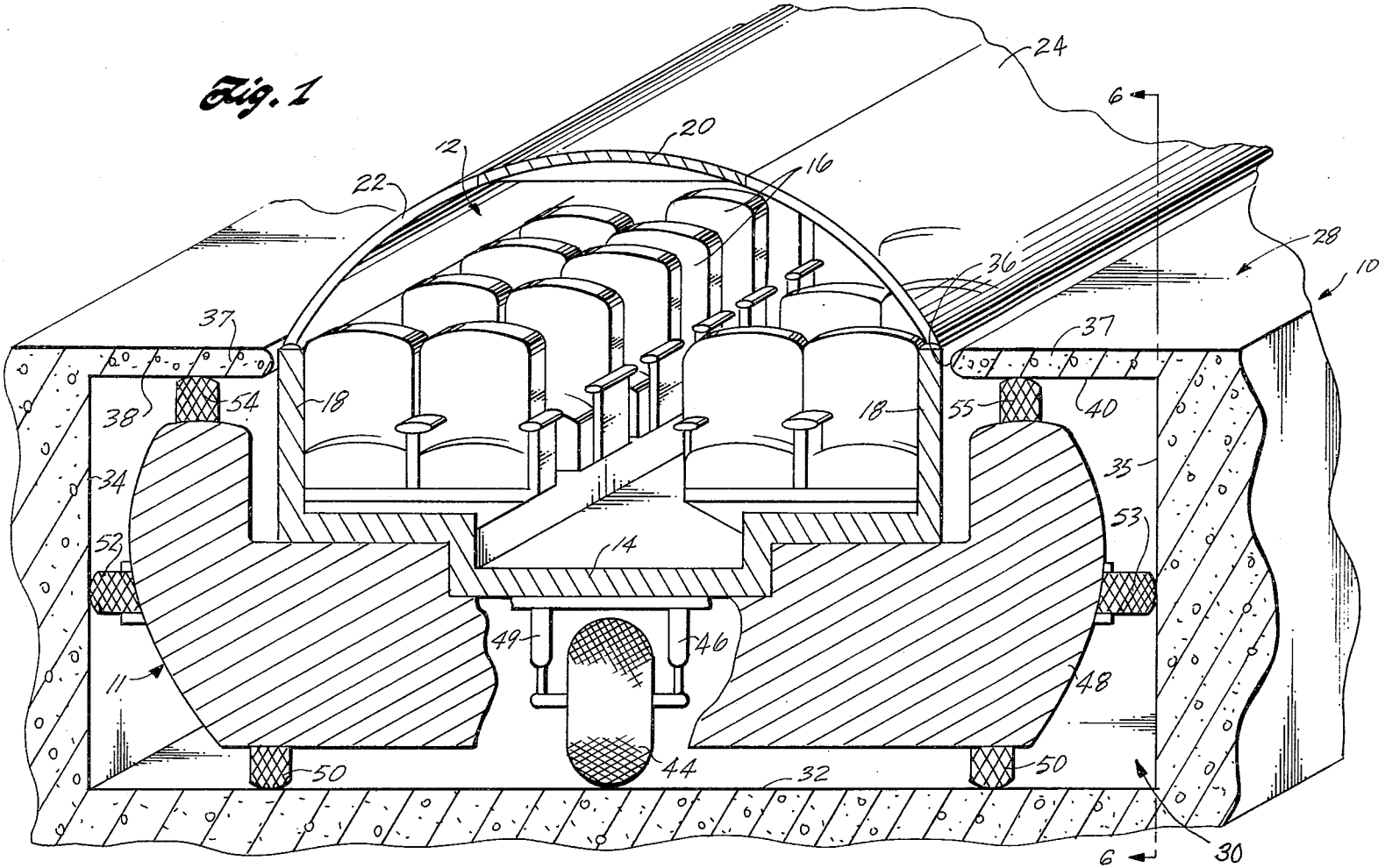
FIG. 1 is a fragmentary schematic perspective view, partly in cross-section, and partly broken away, illustrating a transport vehicle and conduit according to this invention.
Figure 2:
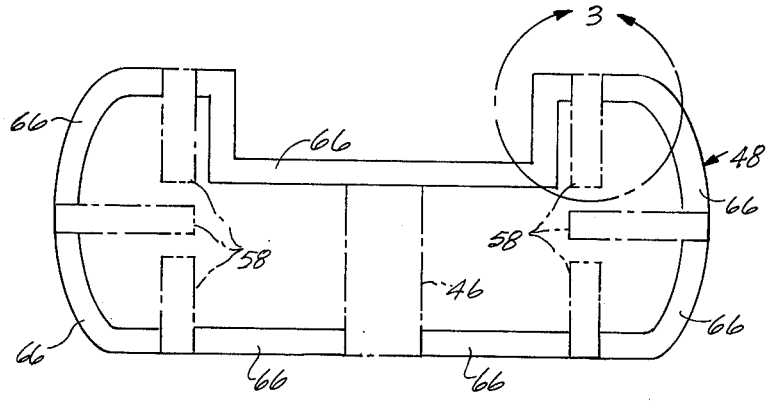
FIG. 2 is a schematic elevation view illustrating means for supporting guide rollers for the transport vehicle.

Referring to the drawings, a passenger transportation system 10 includes a transport vehicle 11 having a passenger compartment 12 which includes a rigid floor structure 14 providing an aisleway for passengers and a means for support for two series of passenger seats 16 on opposite sides of the aisleway. The passenger compartment 12 also includes a pair of elongated rigid upright side walls 18 extending parallel to one another along the length of the transport vehicle. The top of the passenger compartment is preferably domed and includes a curved portion 20 forming the top of the dome, and curved side portions 22 and 24 extending lengthwise along the lower opposite edges of the central portion 20 above the side walls 18. Preferably, the side portions 22 and 24 of the dome are made from a transparent rigid plastic material or glass to provide windows along the length of the vehicle. Entryways (described below) also are provided in these portions of the dome.

As best shown in FIG. 6, the transportation system 10 includes a plurality of vehicles 11 coupled together in series as a train via bellows-type couplings 26, or other suitable couplings.

The transportation system includes an elongated conduit 28 having a hollow interior section 30 along which the train of transport vehicles travel. The conduit 28 is generally channel-shaped in cross-section, and the hollow interior of the conduit includes a bottom surface 32, and upright parallel side walls 34, 35 extending above the bottom surface 32. The upper wall of the conduit includes an elongated slotted opening 36 extending centrally along the length of the conduit. The opening 36 forms inwardly extending upper walls 37 along opposite top edges of the conduit side walls 34, 35. The underside of the upper walls 37 provide upper wall surfaces 38, 40 which lie in the same plane and extend inwardly from the side walls parallel to the bottom surface 32. The conduit preferably is made from a structural material such as reinforced or prestressed concrete. The conduits preferably are made in modular form, and the modules are fitted together at their ends to form a long track for guiding travel of the transport vehicles 11. The conduit end fittings can be provided in any desired manner, such as by techniques known in the concrete pipe industry.

In one form of the invention, the conduits are connected together to form a long tunnel which is placed below ground level. The preferred arrangement is illustrated in FIG. 4 which shows the upper walls 37 of the conduit 28 in the same plane as the ground 42. The tunnel formed by the conduits also can be above ground if desired.

Preferably, each transport vehicle in the train is supported by one or more power-driven wheels 44 at the bottom center of the vehicle. The wheels 44 travel along and in engagement with the conduit bottom surface 32, and each is powered by any suitable drive means. The drive wheel 44 is preferably supported from a suspension system carrier frame (described in detail below) by a hydraulically operated piston-type wheel carrier 46, although other means of suspension, such as a coil spring arrangement, can be used to yieldably support the drive wheel 44 for travel on the conduit floor.

Each transport vehicle 11 is supported for travel in the conduit 28 by a suspension system whch includes a carrier frame 48 for supporting a pair of laterally spaced apart lower guide rollers 50 on opposite sides of the drive wheel 44, together with a pair of laterally spaced apart lateral guide rollers 52, 53 on opposite sides of the carrier frame 48, and a pair of laterally spaced apart upper guide rollers 54, 55 attached to the carrier frame and positioned on opposite sides of the vehicle passenger compartment 12. The lower guide rollers travel along and in engagement with the conduit bottom surface 32. The lateral guide rollers 52, 53 extend outwardly from the opposite edges of the carrier frame 48 and travel along and in engagement with the upright side walls 34, 35, respectively, of the conduit interior. Preferably, the guide rollers 52, 53 are positioned at about the midpoint vertically of the conduit side walls 34, 35. The upper guide rollers 54, 55 travel along and in engagement with the upper wall surfaces 38, 40, respectively of the conduit interior.

The carrier frame 48 provides a means for support for the guide roller suspension system. The suspension system provides biasing means for urging the guide rollers outwardly and into rolling engagement with the inner wall surfaces of the conduit. Each guide roller includes its own separate biasing means, and the total biasing system cooperates to keep the transport vehicle on-center during its travel through the conduit. The separate biasing means hold the respective guide rollers constantly in pressure contact with the inner walls during travel, and compress or expand to always tend to force the vehicle towards its on-center position should the vehicle momentarily stray off-center. The compression or expansion of the biasing means also accommodates the vehicle when it travels along a curved path.

Figure 3:
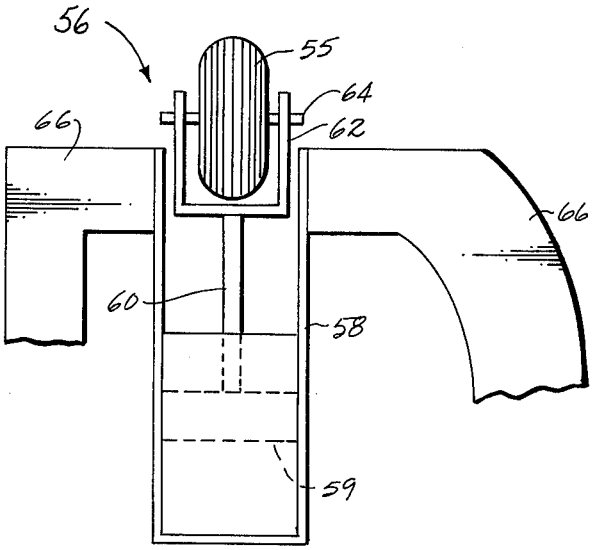
FIG. 3 is an enlarged fragmentary schematic elevation view taken within the circle 3 of FIG. 2 and illustrating a preferred means for supporting a guide roller.

The preferred biasing means comprises separate hydraulically operated wheel carriers 56 for each of the lower, lateral, and upper guide rollers. As illustrated best in FIG. 3, each wheel carrier includes a hydraulic cylinder 58 having a movable piston 59 and a piston arm 60 for supporting a yoke-like wheel support bracket 62 and bearings (not shown) for the guide roller axle 64. The hydraulic control system enables the pistons to respond to pressures exerted on the guide rollers by the conduit during travel of the vehicle to keep the vehicle centered in the conduit. Other types of suspension systems also may be used without departing from the scope of the invention. A typical alternative system would include separate coil spring suspension systems for each guide roller.

The carrier frame 48 can be any of a variety of forms consistent with its function of providing a rigid means of support for the separate guide rollers suspension devices 58 and the drive roller suspension 46. Preferably, the carrier frame 48 comprises a skeleton framework of independent structural members 66 and means (not shown) for bracing the suspension devices and the structural members 66 together as a rigid structural unit.

Moreover, the upright walls 34, 35 of the conduit can be rounded; i.e., curved outwardly substantially parallel to the curved outer edges of the frame 48. This will aid in reducing the amount of play in the lateral rollers 52, 53 as they contact the side walls of the conduit. To reduce friction on the walls, all of the rollers 50, 52, 53, 54 and 55 have less than 1/16 inch play. Further, lateral rollers (not shown) can be carried on the vehicle frame 18 for stable contact with the inner marginal edges 36 of the conduit.

FIGS. 4 through 6 illustrate a transportation system according to this invention for moving large numbers of passengers in urban areas. The conduits 28 are connected together to form an underground tunnel in which the top of the conduit tunnel is at or below ground level. The transport vehicles 11 are coupled together as a train and travel along the tunnel. Each vehicle in the train is supported for rolling engagement with the walls of the conduit by a plurality of the suspension system carrier frame 48. The domed top portion of the passenger compartment 12 preferably projects through the top central opening 36 along the tunnel. The domed top of each vehicle 11 has one or more doors 68 for allowing passengers to enter the passenger compartment. As shown best in FIG. 4, each door is hinged to preferably pivot downwardly to the plane of the conduit upper surface. Passengers entering through the open doorway can step down a stairway 70 to reach the passenger compartment. In an alternate configuration, certain stairways can be replaced by a ramp device (not shown). For example, a preferred ramp device can be hinged in sections and foldable into a compact size during transit, and can be unfolded and be locked into a rigid position providing a foot ramp extending from the vicinity of the conduit upper surface or the sidewalk through the doorway and to the aisleway of the passenger compartment.

In areas subject to extreme weather conditions of heavy snow or rainfall, the open portion of the conduit can be covered by a continuous covering 72 illustrated in FIG. 4. The covering can include entryways (not shown) from street level to the inside of the covering. FIG. 5 illustrates a separate means for covering the open portion of the conduit via automatically operated spring-loaded door sections 74. The door sections can be controlled to open upon the approach of the train and close after the train passes. Moreover, the front section of the train can be configured to provide sufficient snow removal in and of itself for use in instances where the conduit opening is not covered. The interior of the conduit also can have a drainage system (not shown) for snow or water.

The transportation system of this invention provides an efficient means for transporting large numbers of passengers, especially in congested downtown areas. The cost of installing the conduit tunnel is relatively low compared with subways; and the conduit mode of travel provides a faster and safer means of transporting large numbers of passengers through congested areas than buses or other surface means of transportation. The transport system also can move passengers efficiently because the conduit allows the train to travel essentially unaffected by large snow or rainfall. The train also can travel at relatively high speeds with a high degree of safety and comfort because of the combined conduit and suspension system. Moreover, the suspension system makes the overall vehicle relatively light in weight, efficient in terms of fuel economy, and inexpensive to manufacture.

I claim:

1. A passenger transportation system comprising:

an elongated conduit having a generally rectangular-shaped hollow interior defining a bottom wall surface, spaced apart upright side wall surfaces above the conduit bottom surface, and an upper wall surface above the side walls and spaced from the conduit bottom surface, each wall surface being substantially flat from end-to-end, and an elongated opening in the upper wall surface extending continuously along the length of the conduit;

a transport vehicle in the conduit for being transported lengthwise through the conduit;

a suspension system comprising a series of longitudinally spaced apart rigid carrier frames secured to the transport vehicle to support the transport vehicle above the conduit bottom surface, each carrier frame supporting a drive roller traveling on said conduit bottom surface, a pair of bottom guide rollers on opposite sides of the drive roller traveling on said conduit bottom surface, a separate lateral guide roller traveling on each conduit side surface, and a separate upper guide roller traveling on portions of said conduit upper surface on opposite sides of the elongated opening therein;

each carrier frame further supporting a respective biasing means engaged with each roller to urge the drive roller and bottom, lateral, and upper guide rollers outwardly into pressure contact with their respective conduit wall surfaces so as to maintain the transport vehicle centered in the conduit cross-section during transit of the vehicle lengthwise in the conduit, the upper guide rollers extending upwardly into contact with the conduit upper surface portions on opposite sides of the transport vehicle;

the transport vehicle having an elongated interior section for carrying passengers, an upper portion of said interior section projecting through the opening in the conduit continuously along the length of said interior section, and door means in the projecting upper portion of the vehicle for allowing access to the vehicle interior.

2. A passenger transportation system according to claim 1 in which each carrier frame has a recessed central portion for carrying the longitudinal extent of the passenger interior section, the carrier frame further having said upper guide rollers secured to upwardly projecting frame portions extending above said recessed portion on opposite sides of the interior section of the vehicle.

3. A passenger transportation system according to claim 2 including movable conduit closure means extending along the length of said conduit opening to close off the longitudinal extent of the opening, and means for selectively opening portions of the conduit closure means in response to the location of the transport vehicle in the conduit.

4. A passenger transportation system according to claim 3 in which the conduit is made from concrete, and the drive rollers and the guide rollers travel solely on the flat surfaces of the conduit hollow interior.

5. A passenger transportation system according to claim 1 including movable conduit closure means extending along the length of said conduit opening to close off the longitudinal extent of the opening, and means for selectively opening portions of the conduit closure means in response to the location of the transport vehicle in the conduit.

6. A passenger transportation system according to claim 1 in which the conduit is made from concrete, and the drive rollers and guide rollers travel solely on the flat surfaces of the conduit hollow interior.

* * * * *